US005657730A

United States Patent [19]

Gustavsson

[11] Patent Number: 5,657,730

[45] Date of Patent: Aug. 19, 1997

[54] METHOD FOR COLD STARTING PISTON-TYPE COMBUSTION ENGINES AND A DEVICE FOR CARRYING OUT THE METHOD

[75] Inventor: Tommy Gustavsson, Frillesås, Sweden

[73] Assignee: AB Volvo, Sweden

[21] Appl. No.: 536,214

[22] Filed: Sep. 29, 1995

Related U.S. Application Data

[63] Continuation of Ser. No. 133,056, filed as PCT/SE92/00216, Apr. 3, 1992, published as WO92/18761, Oct. 29, 1992, abandoned.

[30] Foreign Application Priority Data

Apr. 12, 1991 [SE] Sweden ..... 9101125

[51] Int. Cl.[6] ..... F02D 9/06; F02N 17/00

[52] U.S. Cl. ..... 123/323; 123/179.16; 123/179.21

[58] Field of Search ..... 123/179.21, 179.1, 123/179.16, 179.17, 491, 676, 323; 60/324

[56] References Cited

U.S. PATENT DOCUMENTS

| | | | |
|---|---|---|---|
| 4,077,381 | 3/1978 | Firey | 123/179.16 |
| 4,096,697 | 6/1978 | Treuil | 60/599 |
| 4,557,233 | 12/1985 | Joppig et al. | 123/323 |
| 4,641,613 | 2/1987 | Delesalle | 123/179.21 |

FOREIGN PATENT DOCUMENTS

| | | | |
|---|---|---|---|
| 0180332 | 9/1985 | European Pat. Off. . | |
| 2625095 | 6/1976 | Germany . | |
| 3339053 | 10/1985 | Germany . | |
| 54-12056 | 1/1979 | Japan . | |
| 57-157031 | 9/1982 | Japan . | |
| 59-122739 | 7/1984 | Japan . | |
| 59-158348 | 9/1984 | Japan . | |
| 59-180041 | 10/1984 | Japan . | |
| 60-138222 | 7/1985 | Japan . | |
| 60-128222 | 7/1985 | Japan | 60/324 |
| 2-64236 | 3/1990 | Japan . | |
| 3-246343 | 11/1991 | Japan | 123/323 |
| 320985 | 2/1970 | Sweden . | |

OTHER PUBLICATIONS

Patent Abstracts of Japan, vol. 8, No. 244, M337, abstract of JP 59–122739, pub. 1, 1984 Jul. 16 Jidosha Kiki K.K.).

Patent Abstracts of Japan, vol. 6, No. 263, M181, abstract of JP 57–1575031, pub. 1, 1982 Sep. 28, (Hino Jidosha Kogyo K.K.).

Patent Abstracts of Japan, vol. 9, No. 7, M350, abstract of JP 59–158348, pub. 1, 1984 Sep. 7, (Hino Jidosha Kogyo K.K.).

*Primary Examiner*—Andrew M. Dolinar

*Attorney, Agent, or Firm*—Lerner, David, Littenberg, Krumholz & Mentlik

[57] ABSTRACT

The invention relates to a method and device for cold starting of piston-type combustion engines. During a first step, the blocking of the fuel supply to the engine's combustion chambers is ensured during cranking of the engine, whereby air is compressed in the engine for the purposes of warming up the engine's combustion chambers by generated compression heat. During a second step, fuel supply is effected during further cranking until ignition occurs, whereby the first step is continued for a predetermined number of revolutions of cranking of the engine.

12 Claims, 1 Drawing Sheet

METHOD FOR COLD STARTING PISTON-TYPE COMBUSTION ENGINES AND A DEVICE FOR CARRYING OUT THE METHOD

This is a continuation of application Ser. No. 08/133,056, filed as PCT/SE92/00216, Apr. 3, 1992 published as WO92/18761, Oct. 29, 1992, now abandoned.

TECHNICAL FIELD

The present invention concerns a method of cold starting piston-type combustion engines.

The present invention also concerns a device for carrying out the method.

STATE OF THE ART

During the cold starting of piston-type combustion engines the combustion is incomplete, implying undesirably high emissions of hydrocarbons amongst other things. This occurs at all surrounding temperatures, but increases with decreasing temperature of the surroundings. It is therefore important to quickly reach the normal running temperature. The most common way is to arrange a pre-heating of the engine inlet air, which requires a space-consuming and cost-consuming electrical heating element in the inlet manifold.

DESCRIPTION OF THE INVENTION

The object of the present invention is to solve the aforesaid start problems in an economical and effective way so that the warming up of the engine happens as quickly as possible even without a heating element being arranged on the inlet side.

Said object is achieved by means of a method which is characterized by a first step, in which the blocking of the fuel supply to the engine's combustion chambers is ensured during cranking of the engine, whereby air is compressed in the engine for the purposes of warming up the engine's combustion chambers by generated compression heat, and a second step, in which fuel supply is effected during further cranking, until ignition occurs, whereby the first step is continued for a predetermined number of revolutions of cranking of the engine.

Said object is achieved also by means of a device, which is characterized in that the device comprises a control unit which is arranged, during a first step, to send a control signal to ensure blocking of the fuel supply to the engine during a predetermined number of revolutions of engine cranking and which, during a second step, is arranged to interrupt said blocking.

DESCRIPTION OF THE FIGURES

The invention shall now be explained in more detail using two embodiments and with respect to the accompanying drawings, in which.

PREFERRED EMBODIMENTS

Figure 1:
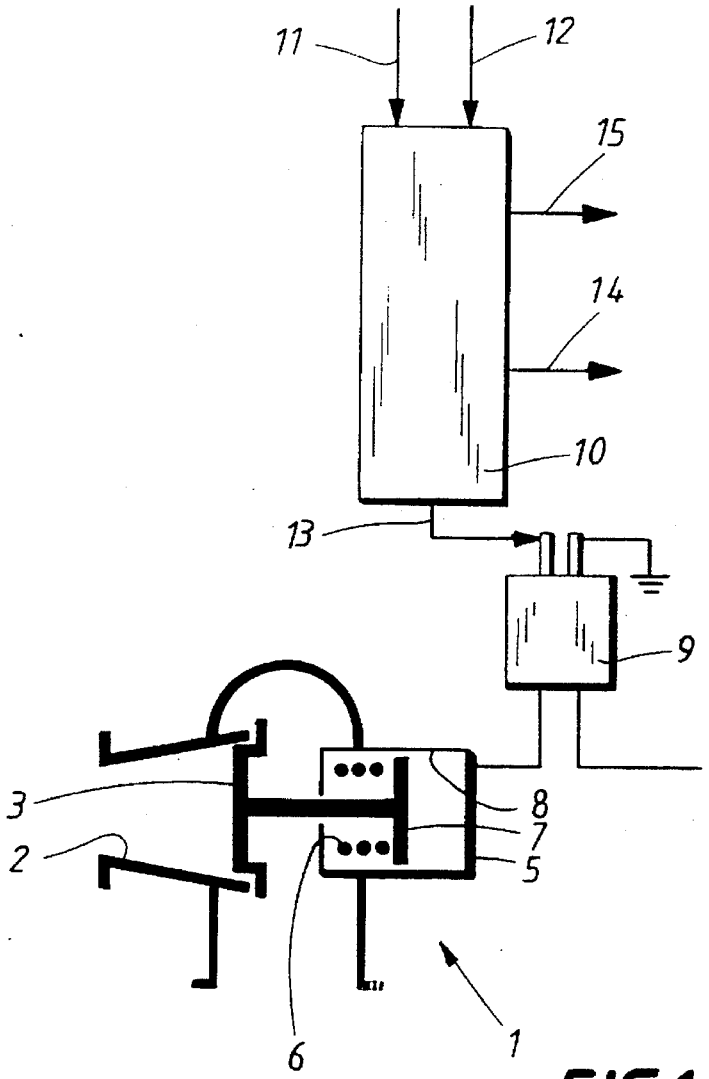
FIG. 1 shows schematically a cold starting arrangement of the invention according to a first embodiment whilst
Figure 2:
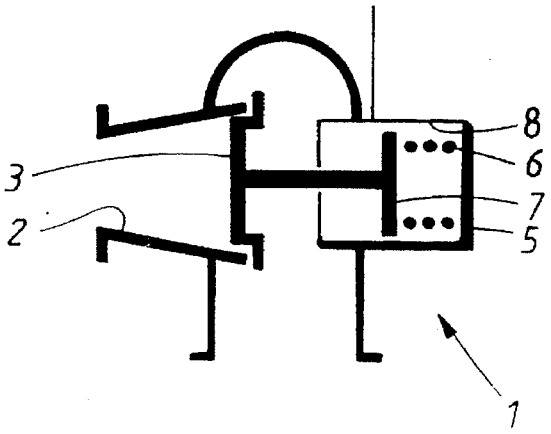
FIG. 2 shows schematically a part of the device according to a second embodiment.

The device according to the invention is preferably, as is clear from FIG. 1 as well as FIG. 2, foreseen with a throttling device 1, which is arranged on the exhaust side 2 of a piston-type combustion engine, for example between its manifold and exhaust pipe. The throttle device presents a valve 3 which is arranged to be continually variably adjusted between a fully closed position, in which the exhaust side is completely blocked, and a fully open position, in which the throttle device makes no contribution to a pressure drop. In the closed position the throttle device can completely block the exhaust side, whereby the valve 3 or attached seating 4 is completely sealed. Alternatively the valve can be foreseen with air holes so that the exhaust side can not be blocked completely. The throttle device is controlled by means of an adjusting part 5, which is for example pneumatically controlled from a pneumatic system belonging to the vehicle, whereby the adjustment part is constituted of a spring biased piston 7, movable in an air cylinder 8, which is single acting and communicates with a pneumatic source via an electrically adjustable solenoid valve 9. This is connected to a control unit 10 which, in cooperation with other functions, is arranged to control the throttle device. The embodiment according to FIG. 1 shows a throttle device of the positive type, implying that the compression spring 6 acts to maintain the valve open. The valve's adjustment is achieved in that a varying air pressure is applied in the air cylinder on the piston's opposite side relative to the compression spring. Maximum throttle position is achieved thus when the force acting on the piston due to air pressure is greater than the spring pressure. The embodiment according to FIG. 2 shows a negatively working arrangement, where the spring thus acts on the piston 7 in the opposite direction, i.e. attempts to maintain maximum throttle position. The air pressure is hereby fed to the other side of the piston and, in the presence of sufficient air pressure, produces a maneuvering movement for opening the valve.

Examples of inputs to the control unit are a control input 11 from the vehicle's ignition lock, a second control input from any transmitter, for example a temperature sender for sensing temperature on the exhaust side, e.g. at each cylinder, a revolution-count sender, revolution calculator, timer etc. Also the cooling fluid temperature or the lubrication oil temperature can be sensed by means of senders for controlling the control unit. As stated, the control unit is connected to the solenoid valve 9, which occurs via an output 13 from the control unit. Additional outputs from the control unit consist for example of an output 14 to the combustion engine's starter motor relay and an output 15 to the engine's fuel injection system. As an example a diesel engine has been chosen, which thus has no electrical ignition system.

The device according to the invention is particularly simple and cost effective by application to certain engine types, such as diesel engines, depending on the fact that in practice an exhaust pressure regulator of the diesel engine can be used as the throttle arrangement 1, said regulator being part of the standard equipment in diesel engines for heavy vehicles, such as trucks. This exhaust pressure regulator has hitherto mainly had the function of creating an artificial load on the engine to such a high level, that it functions as an engine brake for reducing the load on the conventional braking system. This function is connected via for example an electrical brake contact in the vehicle cabin, which leads to an input, for example the input 12, to the control system 10. The exhaust pressure regulator produces moreover a quicker increase of the engine's temperature after start by means of the artificial load which is created by fully or partly closed valve 3, since a resistance pressure is created in the engine, which is utilised after fuel injection and subsequent ignition of the fuel occurs.

The method and device according to the invention imply a further development, which additionally advances the rise of the engine's temperature to its running temperature. This is achieved in that the control unit 10, even at the start of cranking of the diesel engine via a starter motor, partly blocks the fuel injection to the diesel engine depending on a suitably chosen parameter and partly also preferably actuates the throttle device 1 to ensure maximum throttling of the exhaust side. During this first method step, no ignition can thus occur, since the engine's cylinder chambers are not supplied with any fuel, but the pistons in the engine still compress air which is contained in the cylinder, at the same time as the completely or partly closed throttle device 1 produces a resistance pressure on the exhaust side, which also increases the degree of compression as well as reducing the through-flow through the cylinders. This causes the compression in the cylinder chambers to generate compression heat and therewith a heating up of the cylinder chamber's walls, even before the diesel engine commences ignition and running. A second method step, which directly follows on from the first method step, involves continued resistance pressure by means of the throttle device 1 during fuel injection, which is activated by means of the control unit 10 on one of its outputs 15, whereby ignition of the fuel occurs and the engine is made to rotate under its own power. The maintained resistance pressure during the second method step contributes additionally to a fast heating up of the engine during a suitably chosen warm up period whereafter a third step, following on from the second step, involves said resistance pressure substantially being ceased by adjustment of the throttle device's 1 valve 3 to a completely open position. When required, this normal operating condition is replaced by increased engine braking as a result of the driver's actuation on a control input 12 to the control unit 10, so that the throttle device is adjusted to a preferably fully closed position. The blocking of the fuel injection occurs by means of the control output 15, which controls a per se known fuel injection system. The blocking is controlled from a control input to the control circuit, which detects the number of revolutions of the crankshaft and deactivates the blocking after a predetermined number of revolutions, being however at least one complete working cycle of the engine, i.e. at least one compression stroke for each cylinder. From an environmental point of view this is preferred, but from a starting point of view it is possible that the blocking can be deactivated before completion of a whole working cycle. The number of revolutions can also be controlled in dependence on the temperature of the cooling fluid or the lubrication oil.

Choice of a suitable resistance pressure depends on many factors, but can vary between maximum resistance pressure, i.e. fully closed throttle device, and a reduced resistance pressure of for example 100 kPa, when the valve 3 is in an intermediate position between fully open and fully closed positions. Since the exhaust pressure during operation is pulsating, the spring biased throttle device will also pulsate during the first as well as the second method step.

In practice it is arranged that the throttle device 1 is activated already when the engine is cranked by means of the starter motor, taking account of the necessary adjustment time of the throttle device, which for example occurs in that the ignition lock presents a first position, in which blocking of the fuel injection is ensured and the throttle device 1 is adjusted to a predetermined throttle position, whilst a second position involves actuation of the starter motor. The maintaining of the chosen resistance pressure can also occur by means of time control, whereby a timer is preferably included in the control unit 10 and after a predetermined time interval, which is calculated from activation of the engine's cranking, activates the fuel injection via output 14. In the same way, this timer can maintain the throttle device's adjusted throttle position for a predetermined time, until method step two proceeds to method step three.

The invention is not limited to the embodiments described and shown in the drawings but can be varied within the scope of the appended claims. For example it is possible that the throttle device is left out completely or is given another construction and is so arranged that, instead of arranging one throttle device common to all cylinders, a throttle device is arranged for each cylinder to provide individual control, since the cylinders otherwise reach the running temperature at different points in time. Although the invention is particularly advantageous at lower surrounding temperatures, the invention offers advantages independent of the engine temperature and surrounding temperature. In principle the method can simply comprise blocking of the fuel injection. Even if the example relates to diesel engines, the invention is suitable for other sorts of piston-type combustion engines, also for those having an electrical ignition system.

The invention can be used for different types of fuel and shows favourable effects not least for fuels with low vaporisation tendency, i.e. a high vaporisation temperature, such as alcohols.

I claim:

1. Apparatus for cold starting a piston-type combustion engine including a combustion chamber, an exhaust side, a starter, and a fuel supply, said apparatus comprising fuel supply blocking means for blocking the supply of fuel to said combustion chamber, a throttle for throttling said exhaust side of said engine, temperature detecting means for detecting the temperature of said exhaust side of said engine and producing a temperature signal therefrom, and a control unit for controlling both said fuel supply blocking means and said throttle, whereby said supply of fuel to said combustion chamber can be blocked during initial cranking of said engine and throttling of said exhaust side in response to said temperature signal, and said supply of fuel can then be initiated while cranking of said engine and throttling of said exhaust side are continued in order to initiate ignition of said engine, and throttling of said exhaust side can be reduced thereafter.

2. The apparatus of claim 1 wherein said throttle comprises a spring-biased throttle whereby said throttle is biased to maintain the position of said throttle.

3. The apparatus of claim 1 including revolution detecting means for detecting the number of revolutions of said engine and provide a revolution detecting means signal therefrom, and wherein said control means controls said fuel supply blocking means in response to said revolution detecting means signal.

4. The apparatus of claim 3 wherein said revolution detecting means detects a number of revolutions corresponding to at least one complete working cycle of said engine before said control means controls said fuel supply blocking means.

5. The apparatus of claim 1 including an ignition lock, and ignition lock detecting means for detecting the status of said ignition lock and providing an ignition lock signal therefrom, and wherein said control means controls said fuel supply blocking means and said throttle in response to said ignition lock signal whereby said supply of fuel can be blocked and said exhaust side of said engine can be throttled when said engine is cranked.

6. A method for cold starting a piston-type combustion engine including a combustion chamber and an exhaust side comprising initiating cranking of said engine while blocking the supply of fuel to said combustion chamber and throttling said exhaust whereby air is compressed in said engine so as to increase the temperature of said combustion chamber and a resistance pressure is applied to said exhaust side of said engine to further increase said temperature of said combustion chamber, sensing the temperature of said exhaust side of said engine, initiating said supply of fuel to said combustion chamber in response to said sensing of said temperature, while continuing said cranking of said engine and said throttling of said exhaust side in order to initiate ignition of said engine, and reducing said throttling of said exhaust side of said engine.

7. The method of claim 6 wherein said initiating of said cranking of said engine continues for at least one complete working cycle of said engine before said initiating of said supply of fuel to said combustion chamber.

8. The method of claim 6 including calculating the number of revolutions of said engine, and initiating said supply of fuel to said combustion chamber in response to said count of said number of revolutions of said engine.

9. Apparatus for cold starting a piston-type combustion engine including a combustion chamber, an exhaust side, an exhaust pressure regulator for creating a load on said engine, a starter, and a fuel supply, said apparatus comprising fuel supply blocking means for blocking the supply of fuel to said combustion chamber, and a control unit for controlling both said fuel supply blocking means and said exhaust pressure regulator, said control unit actuating said exhaust pressure regulator by means of an electrical brake contact, whereby said supply of fuel to said combustion chamber can be blocked during initial cranking of said engine and creation of said load on said engine, and said supply of fuel can then be initiated while cranking of said engine and creation of said load on said engine are continued in order to initiate ignition of said engine, and creation of said load on said engine can be reduced thereafter, and said creation of said load can also be initiated by said electrical brake contact so as to effect braking thereby.

10. The apparatus of claim 9 wherein said engine comprises a diesel engine.

11. A method for cold starting a piston-type combustion engine including a combustion chamber, an exhaust side, a brake mechanism, and an exhaust pressure regulator for creating a load on said engine comprising initiating cranking of said engine while blocking the supply of fuel to said combustion chamber and creation of a load on said engine whereby air is compressed in said engine so as to increase the temperature of said combustion chamber and a resistance pressure is applied to said exhaust side of said engine to further increase said temperature of said combustion chamber, initiating said supply of fuel to said combustion chamber while continuing said cranking of said engine and said creation of said load on said engine in order to initiate ignition of said engine, activating said exhaust pressure regulator by means of said brake mechanism so as to effect braking thereby, and reducing said creation of said load on said engine.

12. The method of claim 11 wherein said engine comprises a diesel engine.

* * * * *

UNITED STATES PATENT AND TRADEMARK OFFICE

CERTIFICATE OF CORRECTION

PATENT NO. : 5,657,730

DATED : August 19, 1997

INVENTOR(S) : Tommy Gustavsson

It is certified that error appears in the above-identified patent and that said Letters Patent is hereby corrected as shown below:

On the title page: Item [54] and Column 1, line 1,

Delete "FOR" (first occurrence) and insert therefor --OF--.

Column 1, line 1, delete "FOR" and insert therefor --OF-- .

Column 6, line 10, following "starting" insert --and braking--.

Column 6, line 15, delete "creation of a" and insert therefor --creating said--.

Column 6, lines 23 and 24, delete "activating said exhaust pressure regulator by means of said brake mechanism so as to effect braking thereby, and".

Column 6, line 25, following "engine" insert --, and activating said exhaust pressure regulator by means of said brake mechanism so as to effect braking thereby--.

Signed and Sealed this

Fourteenth Day of October, 1997

Bruce Lehman

*Attest:*

BRUCE LEHMAN

*Attesting Officer*

*Commissioner of Patents and Trademarks*